US010443419B2

(12) United States Patent
Thomas et al.

(10) Patent No.: US 10,443,419 B2
(45) Date of Patent: Oct. 15, 2019

(54) SEAL FOR A GAS TURBINE ENGINE ASSEMBLY

(71) Applicants: Rolls-Royce Corporation, Indianapolis, IN (US); Rolls-Royce North American Technologies, Inc., Indianapolis, IN (US)

(72) Inventors: David J. Thomas, Brownsburg, IN (US); John A. Weaver, Indianapolis, IN (US); Ted J. Freeman, Danville, IN (US)

(73) Assignees: Rolls-Royce North American Technologies Inc., Indianapolis, IN (US); Rolls-Royce Corporation, Indianapolis, IN (US)

( * ) Notice: Subject to any disclaimer, the term of this patent is extended or adjusted under 35 U.S.C. 154(b) by 657 days.

(21) Appl. No.: 15/081,399

(22) Filed: Mar. 25, 2016

(65) Prior Publication Data

US 2016/0319687 A1 Nov. 3, 2016

Related U.S. Application Data

(60) Provisional application No. 62/155,222, filed on Apr. 30, 2015.

(51) Int. Cl.

| | |
|---|---|
| ***F01D 11/00*** | (2006.01) |
| ***F01D 11/08*** | (2006.01) |
| ***F01D 25/24*** | (2006.01) |

(52) U.S. Cl.

CPC ..... *F01D 11/005* (2013.01); *F01D 11/08* (2013.01); *F01D 25/24* (2013.01); *F05D 2220/32* (2013.01); *F05D 2240/11* (2013.01); *F05D 2240/55* (2013.01); *F05D 2250/61* (2013.01); *F05D 2250/75* (2013.01)

(58) Field of Classification Search

CPC ..... F01D 11/005; F01D 11/008; F01D 11/02; F01D 11/025; F01D 11/08; F01D 25/24; F05D 2220/32; F05D 2240/55; F05D 2240/11; F05D 2250/61; F05D 2250/75

USPC ..... 277/647

See application file for complete search history.

(56) References Cited

U.S. PATENT DOCUMENTS

| | | | | |
|---|---|---|---|---|
| 3,728,041 | A | 4/1973 | Bertelson | |
| 4,336,943 | A | 6/1982 | Chaplin | |
| 4,361,335 | A | 11/1982 | Vinciguerra | |
| 4,767,260 | A | 8/1988 | Clevenger et al. | |
| 5,076,591 | A | 12/1991 | Gentile | |
| 5,088,888 | A * | 2/1992 | Bobo | F01D 11/005 277/644 |

(Continued)

FOREIGN PATENT DOCUMENTS

WO 2005095763 A1 10/2005

OTHER PUBLICATIONS

Extended European Search Report, European Application No. 16165827.3-1610, dated Sep. 23, 2016, 7 pages.

(Continued)

*Primary Examiner* — Nathan Cumar

(74) *Attorney, Agent, or Firm* — Barnes & Thornburg LLP

(57) ABSTRACT

A gas turbine engine assembly includes a seal formed by the interface between first and second support components. The support components are each formed to include a notch. Adjacent notches cooperate to form a space when assembled. A seal member is located in the space.

17 Claims, 7 Drawing Sheets

(56) References Cited

U.S. PATENT DOCUMENTS

| | | | | |
|---|---|---|---|---|
| 5,158,305 | A | 10/1992 | Halling | |
| 5,338,152 | A | 8/1994 | Feldmann | |
| 5,630,593 | A | 5/1997 | Swensen et al. | |
| 6,568,692 | B2 | 5/2003 | Kolodziej et al. | |
| 6,599,089 | B2 * | 7/2003 | Aksit | F01D 11/005 415/191 |
| 6,648,333 | B2 | 11/2003 | Aksit et al. | |
| 7,128,323 | B2 | 10/2006 | Iguchi et al. | |
| 7,699,320 | B2 | 4/2010 | Iguchi et al. | |
| 7,726,936 | B2 | 6/2010 | Keller et al. | |
| 8,128,343 | B2 | 3/2012 | Schiavo et al. | |
| 8,201,834 | B1 * | 6/2012 | Liang | F01D 11/005 277/637 |
| 2006/0078421 | A1 * | 4/2006 | Balsdon | F01D 11/005 415/170.1 |
| 2006/0256833 | A1 * | 11/2006 | Jiang | G01K 7/02 374/5 |
| 2007/0297900 | A1 | 12/2007 | Abrall et al. | |
| 2013/0177411 | A1 * | 7/2013 | Weber | F01D 11/001 415/209.3 |

OTHER PUBLICATIONS

European Official Action dated Sep. 10, 2018 issued in connection with European Patent Appln. No. 16165827.3, 5 pages.

* cited by examiner

SEAL FOR A GAS TURBINE ENGINE ASSEMBLY

CROSS REFERENCE TO RELATED APPLICATIONS

This application claims priority to and the benefit of U.S. Provisional Patent Application No. 62/155,222, filed 30 Apr. 2015, the disclosure of which is now expressly incorporated herein by reference.

FIELD OF THE DISCLOSURE

The present disclosure relates generally to gas turbine engines, and more specifically to seals used in gas turbine engines.

BACKGROUND

Gas turbine engines are used to power aircraft, watercraft, power generators, and the like. Adjacent components in a gas turbine engine are often separated by a small gap. The small gap allows for variations in manufacturing tolerance of the adjacent components and for expansion/contraction of the components that occurs during operation of the gas turbine engine. Expansion and contraction of the adjacent components is typically caused by the selection of different materials for each component or by different temperatures experienced by each component.

The small gaps between adjacent components may be sealed to prevent the leakage of air through the small gaps during operation of the turbine engine. Seals used to block the leakage of air through the small gaps are sometimes designed to account for changes in the dimension of the gap to be closed.

SUMMARY

The present disclosure may comprise one or more of the following features and combinations thereof.

According to a first aspect of the present disclosure, a seal for a gas turbine engine comprising a first component having a face and a second component having a face abutting the face of the first component. The first and second components separate a region of high pressure from a region of low pressure. The faces of the first and second components each include a discontinuity configured such that when the faces are placed in a confronting relationship, the discontinuities form a space. A seal member is positioned in the space. The seal member cooperates with the cavity such that high pressure gas in the region of high pressure that traverses the interface between the confronted faces urges the seal member against a portion of the discontinuities to seal the interface between the seal member and those portions of the faces engaged by the seal member.

In some embodiments, the discontinuity in the face of the first component and the discontinuity in the face of the second component form an angle with an apex of the angle positioned nearer the region of low pressure as compared the region of high pressure. In some embodiments, the seal member is positioned such that the high pressure that traverses the interface between the confronted faces urges the seal member toward the apex of the angle.

In some embodiments, the face of each of the first and second components comprises a first surface. In some embodiments, the discontinuity in each face includes a second surface intersecting the first surface such that a reflex angle is formed there between.

In some embodiments, the intersections of first and second surfaces of each face are positioned adjacent one another when the faces are positioned in a confronting relationship, the intersections positioned at the apex of the angle formed between the discontinuities.

In some embodiments, an angle formed between the second surfaces of each of the first and second components is an obtuse angle.

In some embodiments, an angle formed between the second surfaces of each of the first and second components is an acute angle.

In some embodiments, each of the faces comprises a third surface that is coplanar with the first surface and spaced apart from the first surface, and wherein each of the faces comprises a fourth surface that intersects the third surface and the second surface, the fourth surface and the third surface forming a reflex angle.

In some embodiments, the seal member is corrugated. In some embodiments, the seal member is perforated. In some embodiments, the seal member is rigid.

According to a second aspect of the present disclosure, a seal for a gas turbine engine comprises a first component having a face and a second component having a face abutting the face of the first component. The first and second components separate a region of high pressure from a region of low pressure. The faces are placed in a confronting relationship such that the faces define a space. A seal member is positioned in the space such that high pressure gas in the region of high pressure urges the seal member against the interface between the faces.

In some embodiments, the space has a tapered shape such that the high pressure gas urges the seal member into the taper to seal the region of high pressure from the region of low pressure. In some embodiments, the seal member is perforated to regulate the flow of gas from the region of high pressure to the region of low pressure. In some embodiments, the seal member is corrugated such that flow paths are defined by the seal member to regulate the flow of gas from the region of high pressure to the region of low pressure. In some embodiments, the seal member is rigid.

In some embodiments, the face of each of the first and second components includes a first surface, a second surface intersecting the first surface such that the first and second surfaces form a reflex angle, a third surface intersecting the second surface, and a fourth surface that is coplanar with the first surface, the fourth surface intersecting the third surface such that the third and fourth surfaces form a reflex angle.

According to a third aspect of the present disclosure, a gas turbine engine assembly comprises a first structural component including a body, the body having a side having a face. A notch is formed in the face. The face has first and second surfaces. The notch includes a third and a fourth surface. The third surface intersects the first surface so that a reflex angle is formed between the first and third surface. The fourth surface intersects the second surface so that a reflex angle is formed between the fourth and second surfaces. The third and fourth surfaces lie between the first and second surfaces. The third surface intersects the fourth surface. The gas turbine engine assembly also comprises a second structural component including a face. The second structural component is positioned so that the face of the second structural component abuts the face of the first structural component so that the notch of the first structural component defines a space between the first and second structural components.

In some embodiments, the angle between the third and fourth surfaces is large enough to permit a direct line of sight from a position outboard of the face of the first component to intersect all of the third and fourth surfaces.

In some embodiments, the first and second structural components are a CMC material. In some embodiments, the first, second, third, and fourth surfaces all include a metallic coating.

These and other features of the present disclosure will become more apparent from the following description of the illustrative embodiments.

DETAILED DESCRIPTION OF THE DRAWINGS

Figure 1:
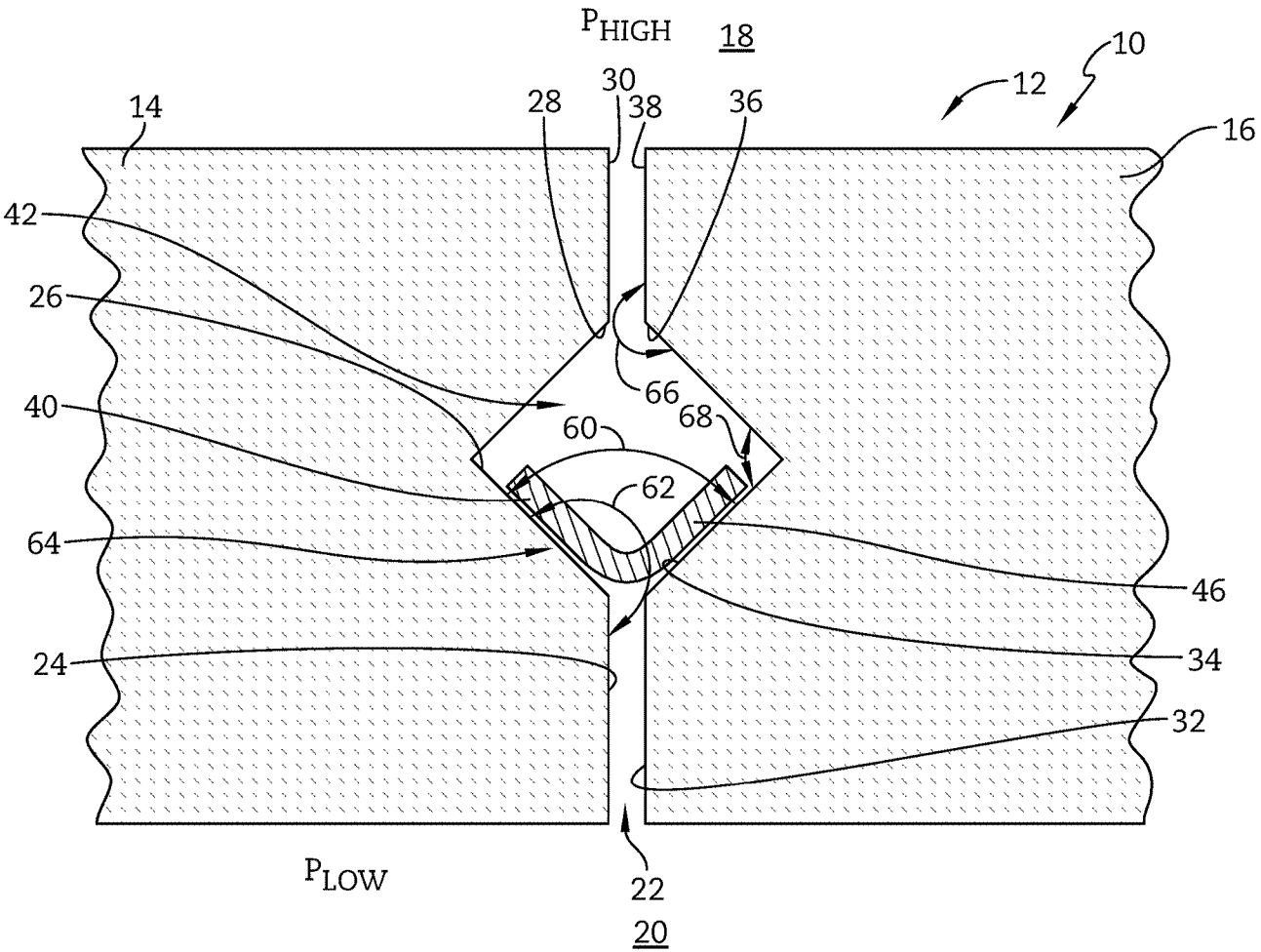
FIG. 1 is a cross-sectional view of two structural components of a gas turbine assembly that are positioned adjacent one another with an interface between the structural components acting as a seal between a region of high pressure and a region of low pressure, the interface including a seal member positioned in a space formed by the adjacent components.

For the purposes of promoting an understanding of the principles of the disclosure, reference will now be made to a number of illustrative embodiments shown in the drawings and specific language will be used to describe the same.

An illustrative gas turbine engine assembly 10 includes a structural assembly 12 that also acts as a seal between a region of high pressure 18 and a region of low pressure 20. The seal 12 includes a first structural component 14 and a second structural component 16 which are arranged adjacently at an interface 22. It should be understood that structural components 14 and 16 may arranged so as to be supported by other structural members which support other components of the engine assembly 10 or may be structural members which are configured to form the seal 12. The structural components 14 and 16 in the illustrative embodiment of FIG. 1 comprise a ceramic material with each structural component 14 and 16 having a side or edge that abuts an adjacent structural component 14 or 16. In the illustrative embodiment of FIG. 1, the interface 22 between components 14 and 16 is configured so that the components 14 and 16 cooperate with a seal member 64 for form seal between the region of high pressure 18 and the region of low pressure 20.

The seal member 64 is an elongated rigid metal strip that is formed into two legs 40 and 46 that are separated by a bend 44. In some embodiments, the seal member 64 may be resiliently pliable under pressure to allow the seal member 64 to conform and better seal the interlace 22. The legs 40 and 46 are bent at an angle 60 so that the legs 40 and 46 engage a surface 26 on structural component 14 and a surface 34 on structural component 16 respectively. High pressure gas from the region of high pressure 18 urges the legs 40 and 46 against the surfaces 26 and 34 so that the legs 40 and 46 tend to seal the region of high pressure 18 from the region of low pressure 20. Thus, high pressure gas is precluded from traversing the interface 22.

Figure 8:
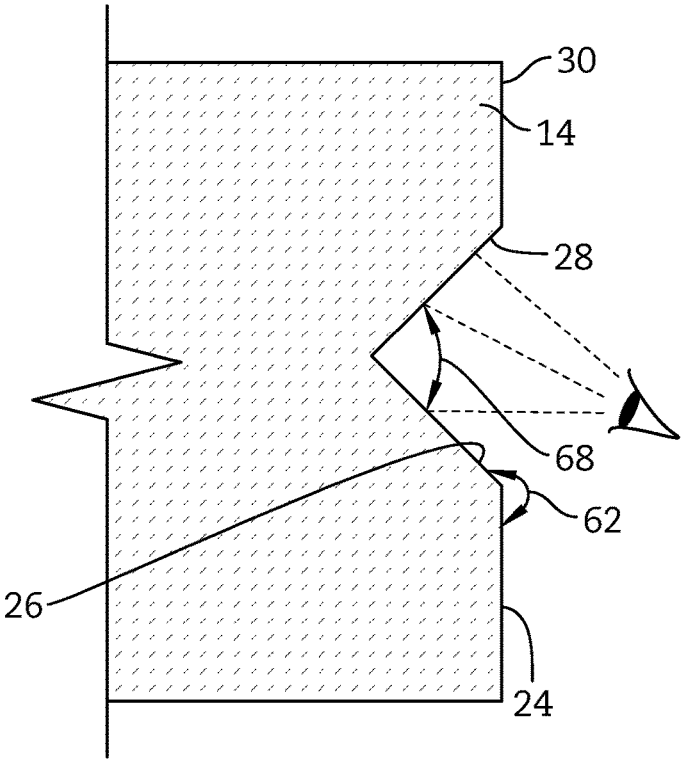
FIG. 8 is a cross-sectional view of a portion of one of the structural members of FIG. 1.

The seal member 64 is retained in a space 42 that is defined when the structural components 14 and 16 are positioned in an abutting relationship. Referring to FIG. 8, a portion of the space 42 is defined by the relationship of surfaces 24, 26, 28 and 30 in the side or edge of the component 14. The surface 24 and 30 are generally coplanar and cooperate to define a face of the edge of component 14. The surface 26 intersects surface 24 so that a reflex angle 62 is formed between the surface 24 and 26. The surface 28 intersects surface 26 so that an angle is formed therebetween. In the illustrative embodiment of FIGS. 1 and 8, the angle between surfaces 28 and 26 is a right angle. In some embodiments, the angle between surfaces 28 and 26 may be an obtuse angle. In other embodiments, the angle between surfaces 26 and 28 may be an acute angle. Effectively, the surfaces 26 and 28 form a notch in the face of the edge of the component 14 defined by the surfaces 24 and 30.

The surface 30 (fourth surface) intersects the surface 28 (third surface) so that a reflex angle is formed between surfaces 30 and 28. In the illustrative embodiment of FIG. 1, the angle between surfaces 30 and 28 is approximately 135°. The structural component 16 is formed to include surfaces 32 (first surface), 34 (second surface), 36 (third surface), and 38 (fourth surface) that mirror surfaces 24(first surface), 26 (second surface), 28 (third surface) and 30 (fourth surface) so that the space 42 is defined when the structural components 14 and 16 are positioned in an abutting relationship. Similar to component 14, component 16 has a notch defined by surfaces 34 and 36 formed in a face defined by surfaces 32 and 38. Based on the angles 66 and 68 between the respective surfaces 34, 36, and 38 that mirror surfaces 26, 28 and 30, the space 42 is generally square in cross-sectional shape. The cross-sectional shape of space 42 reduces the opportunity for seal member 64 to become dislocated in the space 42 when pressure transients are experienced.

The intersections of surfaces 26, 28 and of surfaces 34, 36 may be sharp as shown in the illustrated embodiment in FIG. 1. However, the intersections of surfaces 26, 28 and of surfaces 34, 36 may be a radius or blend as suggested in phantom in FIG. 1.

It should be understood that the spacing of the various components in the present figures may be exaggerated and the components may fit more closely than depicted. In general, the seal 12 formed by the structural components 14 and 16 and seal member 64 is adapted so that the interface 22 is sealed even during expansion and contraction of the adjacent components 14 and 16 that occurs during the operation of the gas turbine engine assembly 10.

Referring now to FIG. 8, it can be seen that the structure of the notch formed by surfaces 26 and 28 in the face of the structural component 14 is accessible with a direct line of sight to all of the surfaces 24, 26, 28, and 30 from the exterior of the structural component 14. This allows the surfaces 24, 26, 28, and 30 to be plasma coated with traditional spraying techniques. This permits an effective and uniform coating of oxides to be deposited on all of the surfaces 24, 26, 28, and 30.

Illustratively, the discontinuity in the face of the first component 14 and the discontinuity in the face of the second component 16 form an angle with an apex of the angle positioned nearer the region of low pressure $P_{LOW}$ as compared the region of high pressure $P_{HIGH}$. However, in other embodiments, the discontinuity in the face of the first component 14 and the discontinuity in the face of the second component 16 may form an angle with an apex of the angle positioned nearer the region of high pressure $P_{HIGH}$ as compared the region of low pressure $P_{LOW}$ or midway between the region of high pressure $P_{HIGH}$ and the region of low pressure $P_{LOW}$.

Figure 2:
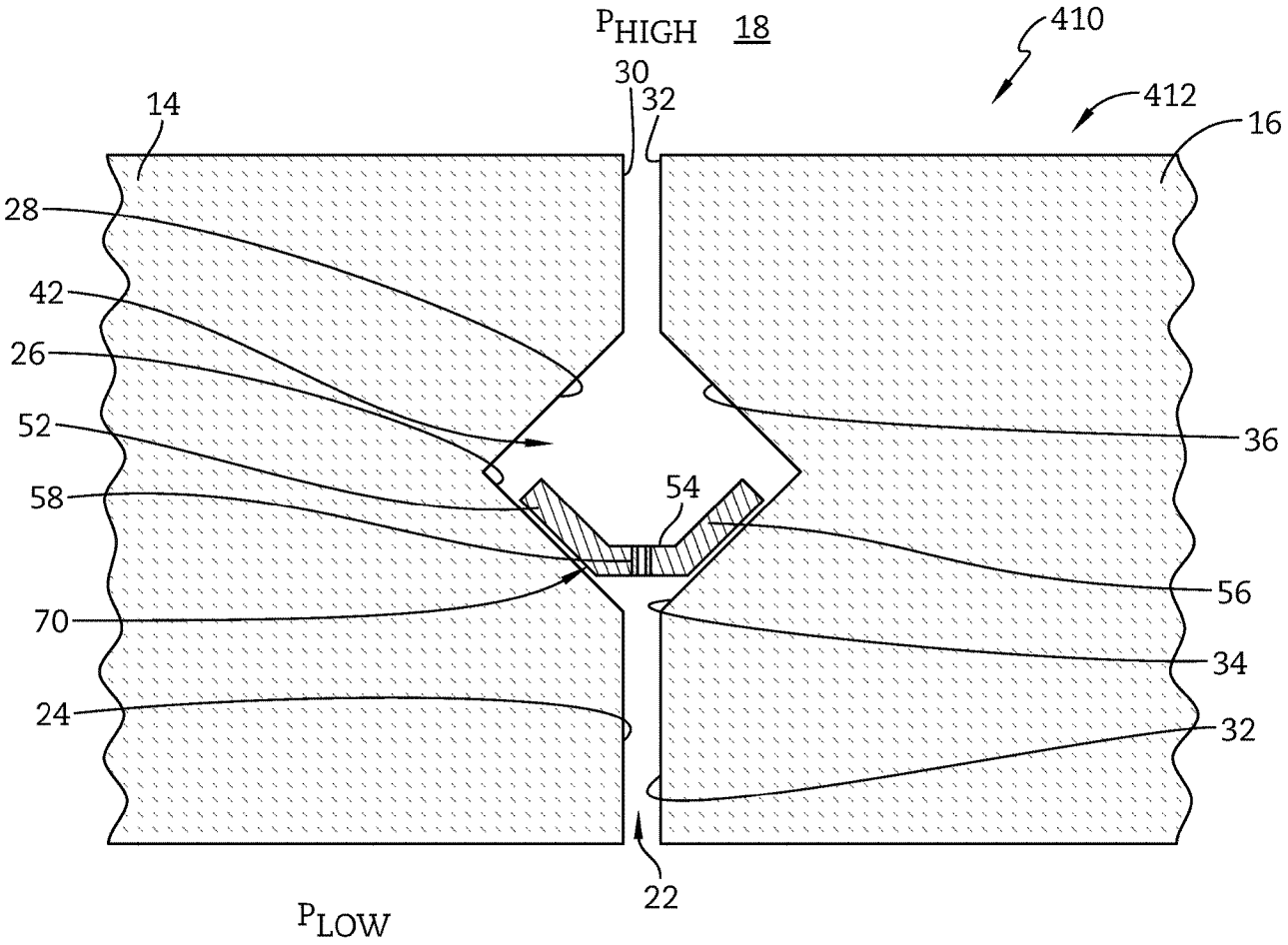
FIG. 2 is a cross-sectional view of another embodiment similar to the embodiment of FIG. 1, FIG. 2 showing a different configuration of seal member.

In another embodiment, a gas turbine engine assembly 410 includes a seal 412 as shown in FIG. 2. The seal 412 includes the structural components 14 and 16 of the embodiment of FIG. 1, but another embodiment of a seal member 70. The seal member 70 is formed from a rigid metallic strip that includes a base 54 and two wings 52 and 56 that are bent upwardly from the base 54 so that the wings 52 and 56 are bent at a 90° angle. The wings 52 and 56 engage the surfaces 26 and 34 respectively, and similarly to the engagement of the legs 40 and 46 of the seal member 64 of the embodiment of FIG. 1. The base 54 is perforated with a number of through-holes 58 formed therethrough along the length of the seal member 70. The through-holes 58 are configured to allow some of the high pressure gas in the region of high pressure 18 to bleed through to the region of low pressure 20 for purge or cooling requirements. It should be understood that the size and number of the through-holes 58 might be varied in various applications to limit or control the flow of gas from the region of high pressure 18 to the region of low pressure 20.

Figure 3:
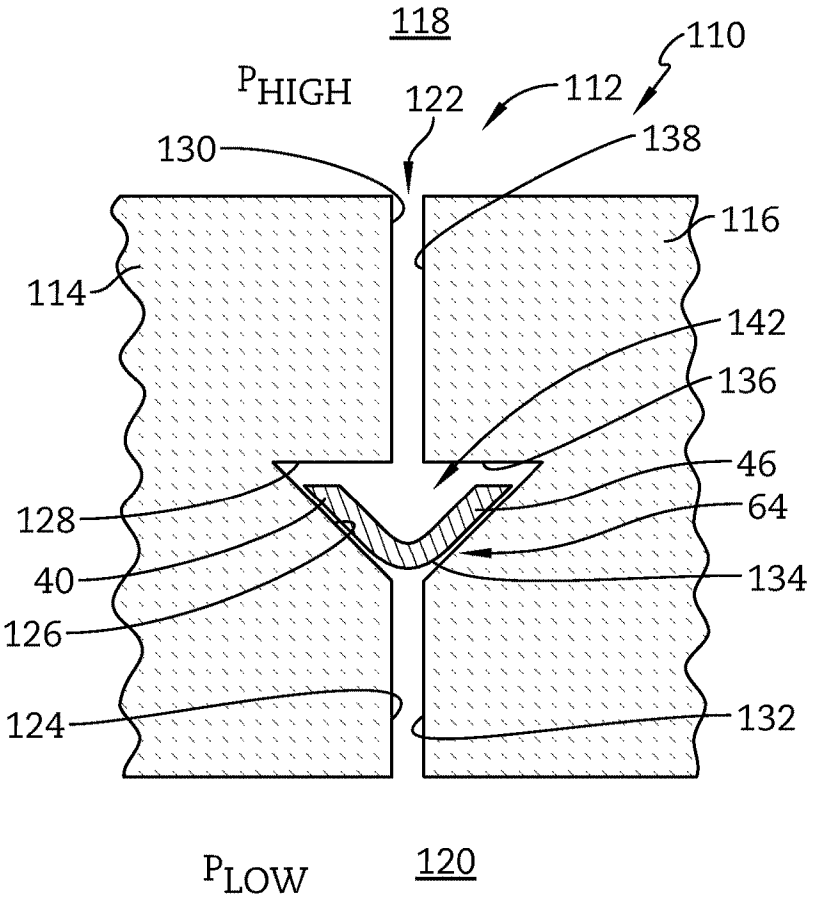
FIG. 3 is a cross-sectional view of yet another embodiment, the embodiment of FIG. 3 having a space to receive a seal member that is configured differently from the space of the embodiments of FIGS. 1 and 2.

In another embodiment of gas turbine engine assembly 110, a seal 112 is formed when two structural components 114 and 116 are positioned in an abutting relationship. An interface 122 is formed between the structural components 114 and 116. The structural component 114 includes a surface 130 that is coplanar with a surface 124 such that the two surfaces 124 and 130 define a face along the edge/side of the structural component 114. A notch or indentation is formed in the face by the intersection of a surface 126 with the surface 124 such that a reflex angle is formed between the surfaces 124 and 126. In the illustrative embodiment, the reflex angle between the surfaces 124 and 126 is 135°. A surface 128 intersects the surface 130 and the surface 126. The surface 128 is generally perpendicular to the surface 130. In the illustrative embodiment of FIG. 3, the angle between the surface 126 and the surface 128 is 45°. The structural component 116 includes surfaces 132, 134,136 and 138 which mirror the surfaces 124,126,128, and 130 when the structural component 114 is positioned to abut the structural component 116, as shown in FIG. 3. The notches formed by surfaces 126 and 128 in structural component 114 and the surfaces 134 and 136 in structural component 116 cooperate to define a space 142 when the structural components 114 and 116 are positioned adjacent one another.

When the structural components 114 and 116 are positioned as shown in FIG. 3, the angle between surfaces 126 and 134 is approximately 90°. In the embodiment of FIG. 3, the seal 112 Includes the seal member 64 discussed above with regard to the embodiment of FIG. 1. The legs 40 and 46 of seal member 64 engage the surfaces 126 and 134 respectively. Thus, the seal member 64 acts to prevent or reduce a flow of gas from an area of high pressure 118 to an area of low pressure 120. In the embodiment of FIG. 3, the space 142 in which the seal number 64 is received is sized to limit the movement of the seal member 64 within the space 142, thereby reducing the potential for the seal member 64 to become dislodged or mis-positioned due to transients in the gas pressure. While the structural components 114 and 116 are shown to be ceramic in FIG. 3, it is contemplated that other materials may be used in a similar construction depending on pressures and temperatures experienced by the gas turbine engine assembly 110.

Figure 4:
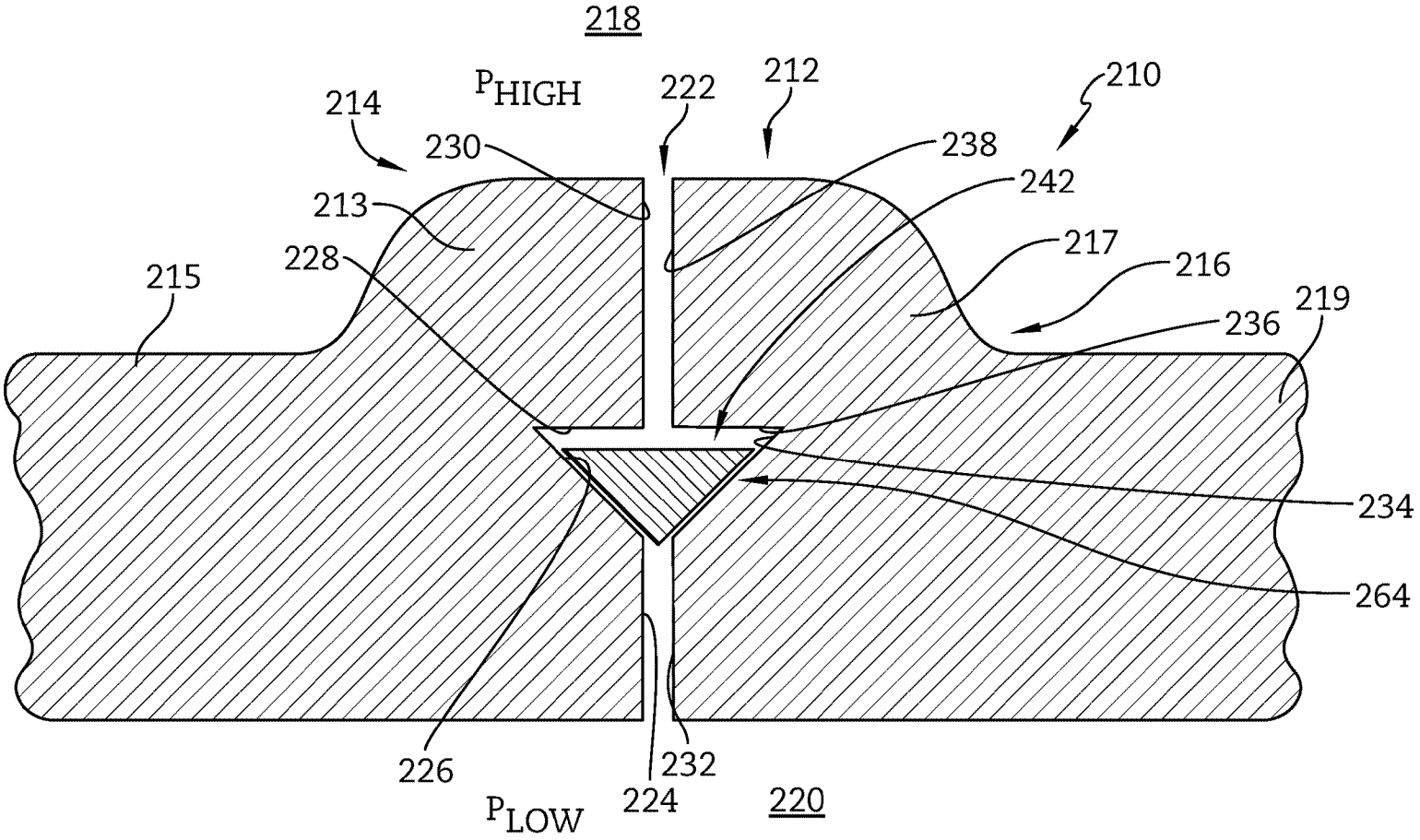
FIG. 4 is a cross-sectional view of still another embodiment, the embodiment of FIG. 4 including a space similar to the embodiment of FIG. 3 and another embodiment of seal member.

For example, another embodiment of gas turbine engine assembly 210 includes a seal 212 that is formed when the edges of a structural component 214 and the structural component 216 are positioned adjacent one another in an abutting relationship. The structural component 214 includes a surface 224 which is coplanar with a surface 230 and cooperate to define a face of the edge of the structural component 214. A notch is formed in the face, the notch being defined by a surface 226 and a surface 228. The surfaces 224,226,228, and 230 are arranged in the same manner as the surfaces 124,126,128, and 130, respectively. Similarly, the structural component 216 includes surfaces 232,234,236, and 238 which are arranged in the same manner as discussed above with regard to the surfaces 132,134,136, and 138, respectively. The notches in the faces of the respective structural components 214 and 216 cooperate to define a space 242. A seal member 264 is positioned in the space 242 to seal the interface 222 between the structural components 214 and 216 to prevent the flow of gas from a region of high pressure 218 to a region of low pressure 220. In the illustrative embodiment of FIG. 4, the seal member 264 is a rigid strip of metal having a triangular cross-section.

The structural components 214 and 216 comprise a metal, such as titanium, for example. As such, the seal 212 is suitable for certain applications. Because the structural components 214 and 216 are metallic, they may be arranged and configured so that portions of the structural components 214 and 216 are thinner, thereby reducing the weight of the gas turbine engine assembly 210. For example, the structural component 214 includes a body 215 and an interface member 213. Similarly, the structural component 216 includes a body 219 and an interface member 217. The interface members 213 and 217 are thicker than the bodies 215 and 219. The thicker interface members 213 and 217 permit larger faces for the interface 222 between the structural components 214 and 216. This thereby allows for a larger space 242 and seal number 264 then would be possible if the structural components 214 and 216 had a uniform thickness.

Figure 5:
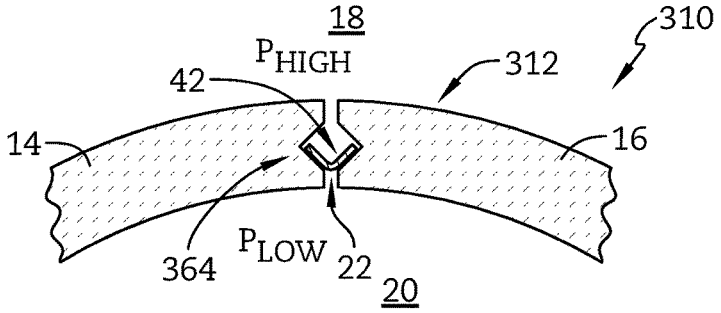
FIG. 5 is a cross-sectional view of still yet another embodiment showing still another embodiment of seal member positioned in space that is configured similarly to the space between the structural components shown in FIGS. 1 and 2.
Figure 6:
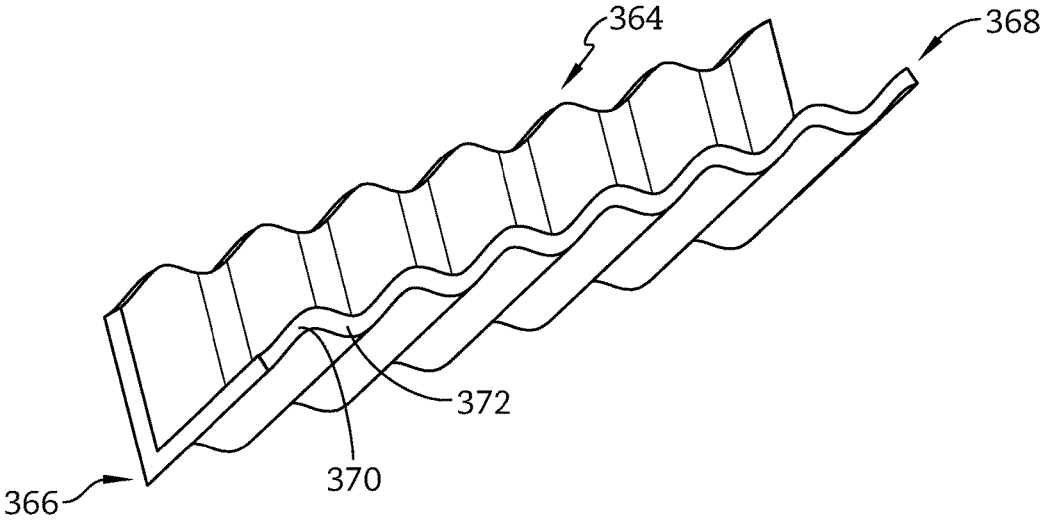
FIG. 6 is a perspective view of the seal member shown in FIG. 5.
Figure 7:
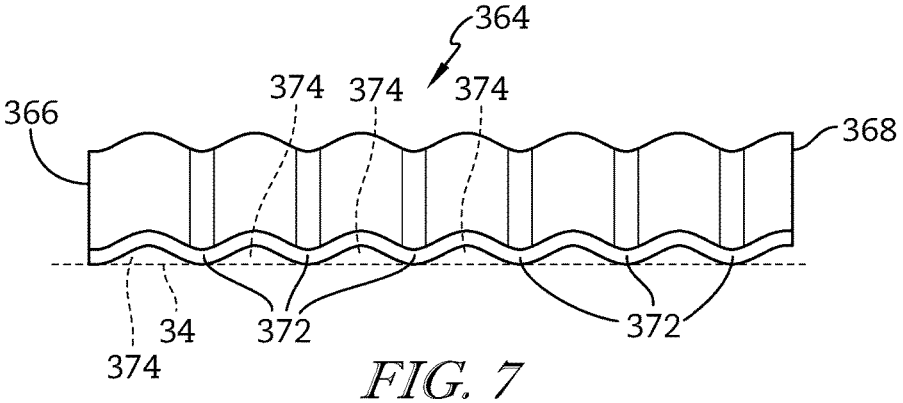
FIG. 7 is a view of the edge of the seal member shown in FIG. 6.

Referring now to FIG. 5, another embodiment of gas turbine engine assembly 310 includes a seal 312. The gas turbine engine assembly 310 includes the structural components 14 and 16 discussed above with regard to FIG. 1. As can be seen in FIG. 5, the structural components 14 and 16 are curved such that when multiple structural components 14 and 16 are placed together they will form an annular structure such as engine housing or a blade track, for example. In the gas turbine engine assembly 310, the seal member 64 of the embodiment of FIG. 1 is omitted and replaced with a seal member 364. The seal member 364 is a strip of corrugated material as shown in FIG. 6. The corrugations vary from a first end 366 to a second end 368 such that there are multiple raised areas 370 and multiple reduced areas 372. Referring now to FIG. 7 it can be seen that when the seal member 364 is positioned against the surface 34 of structural component 16, a space 374 is formed between each raised area 370 and the surface 34. The spaces 374 provide a flow path for gas to flow from a region of high pressure 18 to a region of low pressure 20. In some embodiments, the seal member 364 may be pliable and resilient such that under extreme pressures the seal member 364 deforms to close the gaps 374, thereby limiting or eliminating the flow of gas from the region of high pressure 18 to a region of low pressure 20. It is contemplated that the materials selected and dimensions of the corrugations may be adjusted to control the flow of gas through the interface 322 and the conditions required to deform the seal member 364.

Figure 9:
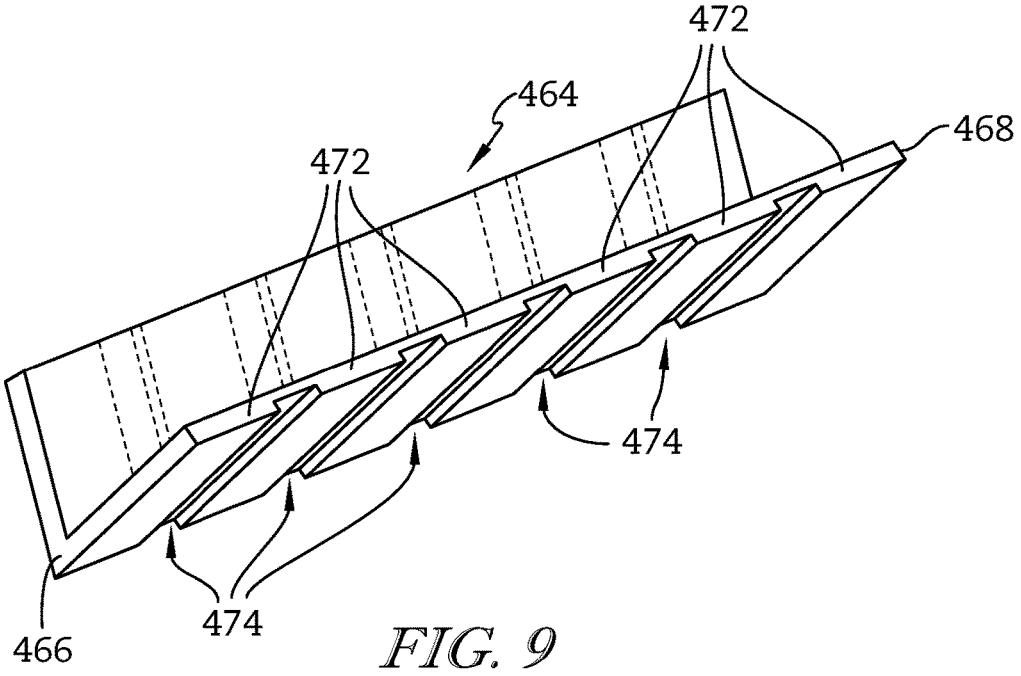
FIG. 9 is a perspective view of yet another embodiment of seal member.

In some embodiments, the seal member 364 may be omitted and replaced with a seal member 464 shown in FIG. 9. The seal member 464 is similar to the seal member 364; however, the seal member 464 has a number of channels 474 formed along the length of the seal member 464 from a first into 466 to a second and 468. The channels 474 are interposed between ribs 472. The channels 474 provide a flow path for gas to flow past the seal member 464. It is contemplated that the location, size, number, and pattern of channels 474 may be varied for different applications to control or define the amount of flow of gas from a region of high pressure to region of low pressure when the seal member 464 is used in a particular seal.

Figure 10:
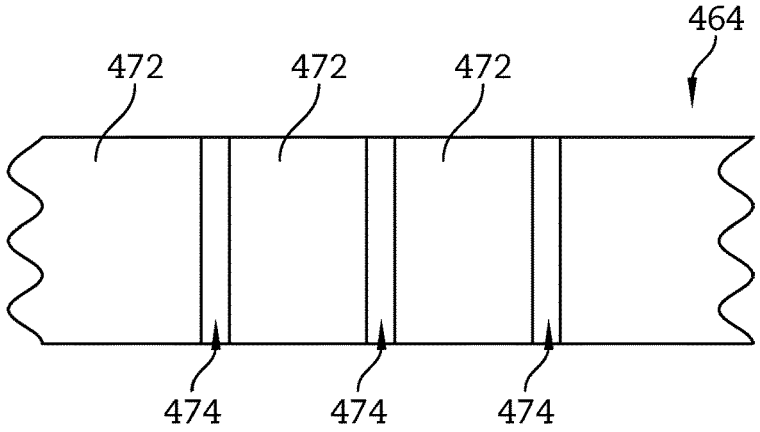
FIG. 10 is a detail view of a portion of the seal member of FIG. 9 showing channels formed in the seal member.
Figure 11:
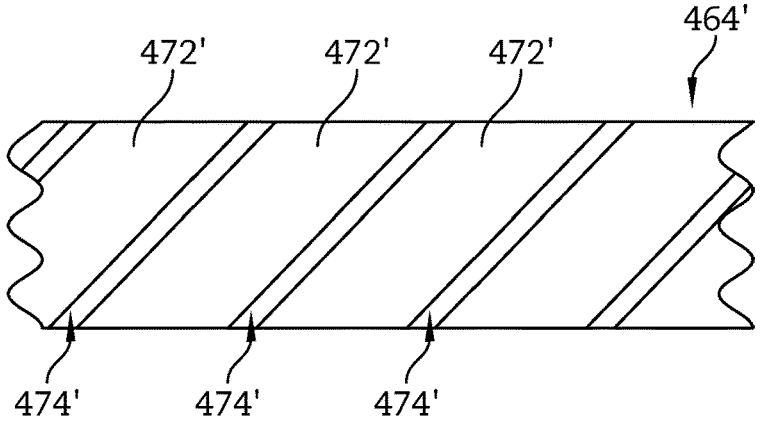
FIG. 11 is a detail view of a portion of a seal member similar to that shown in FIG. 9 showing angled channels formed in the seal member.
Figure 12:
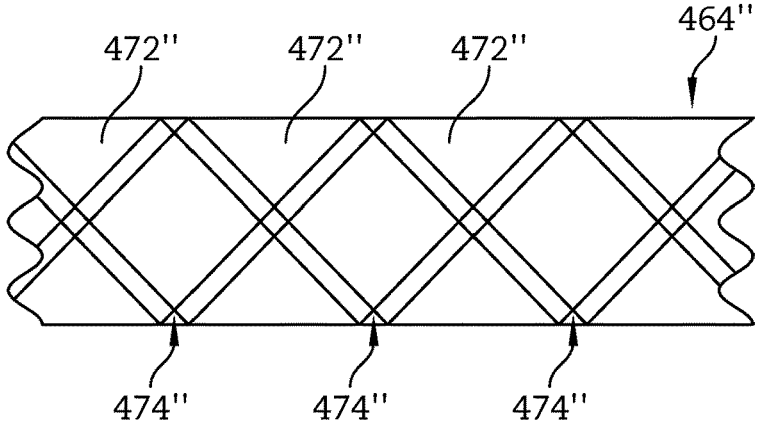
FIG. 12 is a detail view of a portion of a seal member similar to that shown in FIG. 9 showing intersecting channels formed in the seal member.

For example, as shown in FIG. 10, the channels 474 may extend in a generally straight line from a radially outer side to a radially inner side of the seal member 464. In another example, shown in FIG. 11, channels 474' may extend at an angle from a radially outer side to a radially inner side of a seal member 464'. In yet another example, shown in FIG. 12, channels 474" may intersect one another to form a hatched pattern as they extend from a radially outer side to a radially inner side of a seal member 464".

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A seal for a gas turbine engine comprising:

a first component having a face and a second component having a face abutting the face of the first component, the first and second components separating a region of high pressure from a region of low pressure, the faces of the first and second components each including a discontinuity configured such that when the faces are placed in a confronting relationship, the discontinuities form a cavity, and a seal member positioned in the cavity, the seal member cooperating with the cavity such that high pressure gas in the region of high pressure that traverses the interface between the confronted faces urges the seal member against a portion of the discontinuities to seal the interface between the seal member and those portions of the faces engaged by the seal member, wherein the discontinuity in the face of the first component and the discontinuity in the face of the second component form an angle with an apex of the angle positioned nearer the region of low pressure as compared the region of high pressure, the seal member positioned such that the high pressure that traverses the interface between the confronted faces urges the seal member into contact with the faces defining the angle to control the flow of gas from the region of high pressure to the region of low pressure.

2. The seal of claim 1, wherein the face of each of the first and second components comprises a first surface, the discontinuity in each face comprises a second surface intersecting the first surface, and the first surface cooperates with the second surface to form a reflex angle.

3. The seal of claim 2, wherein the intersections of first and second surfaces included in the first and second components are positioned adjacent one another when the faces are positioned in a confronting relationship.

4. The seal of claim 3, wherein an angle formed between the second surfaces of each of the first and second components is an obtuse angle.

5. The seal of claim 3, wherein an angle formed between the second surfaces of each of the first and second components is an acute angle.

6. The seal of claim 3, wherein each of the faces comprises a third surface that is coplanar with the first surface and spaced apart from the first surface, and wherein each of the faces comprises a fourth surface that intersects the third surface and the second surface, the fourth surface and the third surface forming a reflex angle.

7. The seal of claim 3, wherein the seal member is corrugated.

8. The seal of claim 3, wherein the seal member is perforated.

9. The seal of claim 3, wherein the seal member is rigid.

10. A seal for a gas turbine engine comprising: a first component having a face and a second component having a face mirroring the face of the first component, the first and second components separating a region of high pressure from a region of low pressure, the faces placed in a confronting relationship, such that the faces define a space, and a seal member positioned in the space such that high pressure gas in the region of high pressure urges the seal member against an interface between the faces, wherein the space has a tapered shape such that the high pressure gas urges the seal member into the taper to seal the region of high pressure from the region of pressure.

11. The seal of claim 10, wherein the seal member is perforated to regulate the flow of gas from the region of high pressure to the region of low pressure.

12. The seal of claim 10, wherein the seal member is corrugated such that flow paths are defined by the seal member to regulate the flow of gas from the region of high pressure to the region of low pressure.

13. The seal of claim 12, wherein the seal member is rigid.

14. The seal of claim 10, wherein the face of each of the first and second components includes a first surface, a second surface intersecting the first surface such that the first and second surfaces form a reflex angle, a third surface intersecting the second surface, and a fourth surface that is coplanar with the first surface, the fourth surface intersecting the third surface such that the third and fourth surfaces form a reflex angle.

15. The assembly of claim 1, wherein the reflex angle between the second and third linear surfaces is large enough to permit a direct line of sight from a position outboard of the face of the first component to intersect all of the second and third linear surfaces.

16. The assembly of claim 1, wherein the first and second structural components are a CMC material.

17. The assembly of claim 1, wherein the first, second, third, and fourth surfaces all include a metallic coating.

* * * * *